US010286332B2

(12) United States Patent
Fish

(10) Patent No.: US 10,286,332 B2
(45) Date of Patent: May 14, 2019

(54) TOY CONSTRUCTION SET WITH ARTICULATING LINKABLE ELEMENTS

(71) Applicant: KMA Concepts Limited, North Point (HK)

(72) Inventor: Peter Alan Fish, Wyong Creek (AU)

(73) Assignee: KMA Concepts Limited, North Point (HK)

( * ) Notice: Subject to any disclaimer, the term of this patent is extended or adjusted under 35 U.S.C. 154(b) by 0 days.

(21) Appl. No.: 15/919,217

(22) Filed: Mar. 13, 2018

(65) Prior Publication Data

US 2018/0200640 A1 Jul. 19, 2018

Related U.S. Application Data

(63) Continuation-in-part of application No. PCT/US2016/058320, filed on Oct. 21, 2016, which is a continuation of application No. 14/922,105, filed on Oct. 23, 2015, now Pat. No. 9,782,688.

(30) Foreign Application Priority Data

Mar. 21, 2017 (AU) ..... 2017100326

(51) Int. Cl.

| | |
|---|---|
| ***A63H 33/04*** | (2006.01) |
| ***A63H 3/16*** | (2006.01) |
| ***A63H 33/06*** | (2006.01) |
| ***A63H 3/20*** | (2006.01) |
| ***A63H 5/00*** | (2006.01) |

(52) U.S. Cl.

CPC ..... *A63H 33/062* (2013.01); *A63H 3/16* (2013.01); *A63H 3/20* (2013.01); *A63H 5/00* (2013.01)

(58) Field of Classification Search

CPC ..... A63H 33/00; A63H 33/04; A63H 33/08; A63H 33/062; A63H 33/086; A63H 33/105; E04C 1/00; E04C 1/39

USPC .... 446/85, 97, 102, 104–109, 120, 122–128

See application file for complete search history.

(56) References Cited

U.S. PATENT DOCUMENTS

| | | | |
|---|---|---|---|
| 1,965,601 | A | 7/1934 | Kotrbaty |
| 2,296,699 | A | 9/1942 | Bourdelais, Sr. et al. |
| 2,662,335 | A | 12/1953 | Calverley |
| 3,102,367 | A | 9/1963 | Pederson et al. |
| 3,477,167 | A | 11/1969 | Ach |

(Continued)

FOREIGN PATENT DOCUMENTS

| | | |
|---|---|---|
| CN | 101222843 | 7/2008 |
| CN | 203634828 | 6/2014 |

(Continued)

*Primary Examiner* — Kien T Nguyen

(74) *Attorney, Agent, or Firm* — Lamorte & Associates P.C.

(57) ABSTRACT

A toy construction set that contains a plurality of interlocking pieces. Each of the interlocking pieces contains at least one linkage construct. Each linkage construct includes a pivot hub that has a first surface and an opposite second surface. Detents are formed into both surfaces of the pivot hub. Two yoke arms are coupled to each pivot hub. Protrusions extend from the interior surfaces that are sized to be received by one of the detents. Gap spaces separate the yoke arms. Each of the gap spaces is sized to receive and retain the pivot hub of another piece, wherein the pivot hubs on all the pieces are uniform in shape and size.

15 Claims, 5 Drawing Sheets

(56) References Cited

U.S. PATENT DOCUMENTS

| | | | | |
|---|---|---|---|---|
| 3,487,579 | A | 1/1970 | Brettingen | |
| 3,605,322 | A | 9/1971 | Matsubayashi et al. | |
| 3,777,393 | A | 12/1973 | Baer | |
| 3,791,091 | A | 2/1974 | Albrizzi | |
| 4,606,732 | A | 8/1986 | Lyman | |
| 4,789,369 | A | 12/1988 | Lyman | |
| 5,049,104 | A | 9/1991 | Olsen | |
| 5,172,534 | A | 12/1992 | Milner et al. | |
| 5,503,497 | A | 4/1996 | Dudley et al. | |
| 5,582,488 | A | 12/1996 | Dudley et al. | |
| 5,605,486 | A | 2/1997 | Zheng | |
| 5,897,417 | A | 4/1999 | Grey | |
| 5,910,038 | A | 6/1999 | Zheng | |
| 6,135,851 | A | 10/2000 | Drake et al. | |
| 6,264,522 | B1 | 7/2001 | Dickson | |
| 6,447,358 | B1 | 9/2002 | Mikkelsen et al. | |
| 6,508,689 | B1 | 1/2003 | Mikkelsen et al. | |
| 6,612,766 | B2 | 9/2003 | Collins | |
| 6,681,779 | B2 | 1/2004 | Stachowski | |
| 6,702,642 | B1 | 3/2004 | Parein | |
| 6,948,998 | B2 * | 9/2005 | Bagley | A63H 33/062 446/104 |
| D516,135 | S | 2/2006 | Kim | |
| D517,128 | S | 3/2006 | Kim | |
| 8,602,833 | B2 | 12/2013 | Binder | |
| 8,742,814 | B2 | 6/2014 | Binder | |
| 8,887,354 | B1 | 11/2014 | Weinman | |
| 9,320,980 | B2 | 4/2016 | Schweikardt et al. | |
| 9,419,378 | B2 | 8/2016 | Bdeir | |
| D768,471 | S | 10/2016 | Marquez | |
| 9,472,112 | B2 | 10/2016 | Schweikardt et al. | |
| 9,597,607 | B2 | 3/2017 | Bdeir | |
| D786,984 | S | 5/2017 | Pouliot et al. | |
| D794,502 | S | 8/2017 | Siegel | |
| 9,782,688 | B2 * | 10/2017 | Cummings | A63H 33/062 |
| D809,611 | S | 2/2018 | Deblois | |
| 2004/0224601 | A1 | 11/2004 | Bagley | |
| 2005/0014440 | A1 | 1/2005 | Kunitz | |
| 2005/0053414 | A1 | 3/2005 | Collins | |
| 2005/0136792 | A1 | 6/2005 | Zawitz | |
| 2006/0189248 | A1 | 8/2006 | O'Brien | |
| 2006/0200171 | A1 | 9/2006 | Teague | |
| 2006/0225667 | A1 | 10/2006 | Handelsman et al. | |
| 2006/0280545 | A1 | 12/2006 | Zawitz | |
| 2007/0228224 | A1 | 10/2007 | Lehmann | |
| 2008/0120865 | A1 | 5/2008 | Smith | |
| 2008/0160874 | A1 | 7/2008 | Silverglate | |
| 2008/0184649 | A1 | 8/2008 | Khan | |
| 2011/0120490 | A1 | 5/2011 | King | |
| 2015/0308609 | A1 | 10/2015 | Moens | |

FOREIGN PATENT DOCUMENTS

| | | |
|---|---|---|
| CN | 105650204 | 6/2016 |
| EP | 2813271 | 11/2015 |
| JP | 2014104258 | 4/2016 |
| JP | 2014039789 | 7/2016 |
| KR | 100712423 | 4/2007 |
| KR | 100867340 | 11/2008 |
| KR | 100870371 | 11/2008 |
| WO | WO2000021629 | 4/2000 |
| WO | WO2000044462 | 8/2000 |
| WO | WO2005005008 | 1/2005 |
| WO | WO2014040602 | 3/2014 |
| WO | WO2014106796 | 7/2014 |
| WO | WO2017070621 | 4/2017 |

* cited by examiner

TOY CONSTRUCTION SET WITH ARTICULATING LINKABLE ELEMENTS

RELATED APPLICATIONS

This application is a continuation in part of co-pending international application No. PCT/US2016/058320 filed on Oct. 21, 2016, which claims the benefit of U.S. patent application Ser. No. 14/922,105 filed on Oct. 23, 2015, now issued U.S. Pat. No. 9,782,688. This application also claims the priority of Australian Innovation Patent No. 2017100326 filed Mar. 21, 2017.

BACKGROUND OF THE INVENTION

1. Field of the Invention

In general, the present invention relates to toy construction elements that are designed to interconnect into chains. More particularly, the present invention relates to toy construction elements that can move relative other connected pieces once interconnected into an assembly.

2. Prior Art Description

Toy construction sets with plastic parts that interconnect are well known in the toy industry. Most such construction sets are designed with blocks that interconnect in a static manner. Such building blocks are exemplified by the Lego® lines of building blocks. Still other building sets have parts that interconnect at joints. In this manner, the parts can be interconnected to create flexible chains. Such building sets are exemplified by U.S. Pat. No. 5,172,534 to Milner, entitled Chainable Building Blocks.

The construction toy design of U.S. Pat. No. 5,172,534 has been commercialized and has been sold under the trademark Klixx® for the last two decades. The Klixx® trademark is now owned by KMA Concepts, the applicant herein.

Much of the play value of the Klixx® line of toys is that the individual elements interconnect to create a flexible chain. Each element serves as a link in the chain. As such, any one element can only attach to two other parts, one behind and one in front. The resulting chain can be bent and turned into a variety of shapes, but the available shapes are finite. Furthermore, there is little structural integrity available at the interconnection points between toy elements. As a result, large chain structures have a tendency to bend and collapse under the force of their own weight if configured into many three-dimensional shapes.

The present invention is an improvement upon the toy design shown in U.S. Pat. No. 5,172,534. In the improvement, the structure of the toy elements is altered in order to enable more than three elements to interconnect. In this manner, the toy construction set is not limited to creating flexible chains. Rather, the toy construction elements can create three-dimensional constructs, wherein elements progress in a variety of different directions from common points. The integrity of the connection between elements is also improved so that large constructs maintain their constructed form. This enables the toy construction set to be configured into countless shapes, and ensures that the parts within the construct can be adjusted when desired. The improved design is described and claimed below.

SUMMARY OF THE INVENTION

The present invention is a toy construction set that contains a plurality of interlocking pieces. Each of the interlocking pieces contains at least one linkage construct. The number of linkage constructs can vary between individual pieces.

Each linkage construct includes a pivot hub. The pivot hub has a first surface and an opposite second surface that are separated by a common side wall. The first surface and the second surface are parallel.

Detents are formed into both the first surface and the second surface of the pivot hub. The detents are arranged in a radial pattern.

A first yoke arm is coupled to the pivot hub. The first yoke arm has a first interior surface and a first exterior surface. The first interior surface and the first exterior surface are oriented to be perpendicular to both the first surface and the second surface of the pivot hub.

A first protrusion extends from the first interior surface of the first yoke arm. The protrusion is sized to be received by one of the detents. Likewise, a second yoke arm extends from the pivot hub. The second yoke arm has a second interior surface and a second exterior surface, wherein the second interior surface and the second exterior surface are arranged perpendicular to both the first surface and the second surface of the pivot hub.

A first gap space separates the first interior surface of the first yoke arm from the second interior surface of the second yoke arm. If more than one linkage construct is in the piece, then additional gap spaces are also present between the linkage constructs. Each of the gap spaces is sized to receive and retain the pivot hub of another piece, wherein the pivot hubs on all the pieces are uniform in shape and size.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

The present invention construction toy system contains a variety of parts. The different parts can be embodied in many ways. However, each of the parts share a common linkage construct. It is the number of linkage constructs that varies from part to part. For the purposes of illustration and description, only a few exemplary part configurations are shown. The illustrated parts represent some of the best modes contemplated for the invention. The illustrated parts, however, are merely exemplary and should not be considered as limitations when interpreting the scope of the appended claims.

Figure 1:
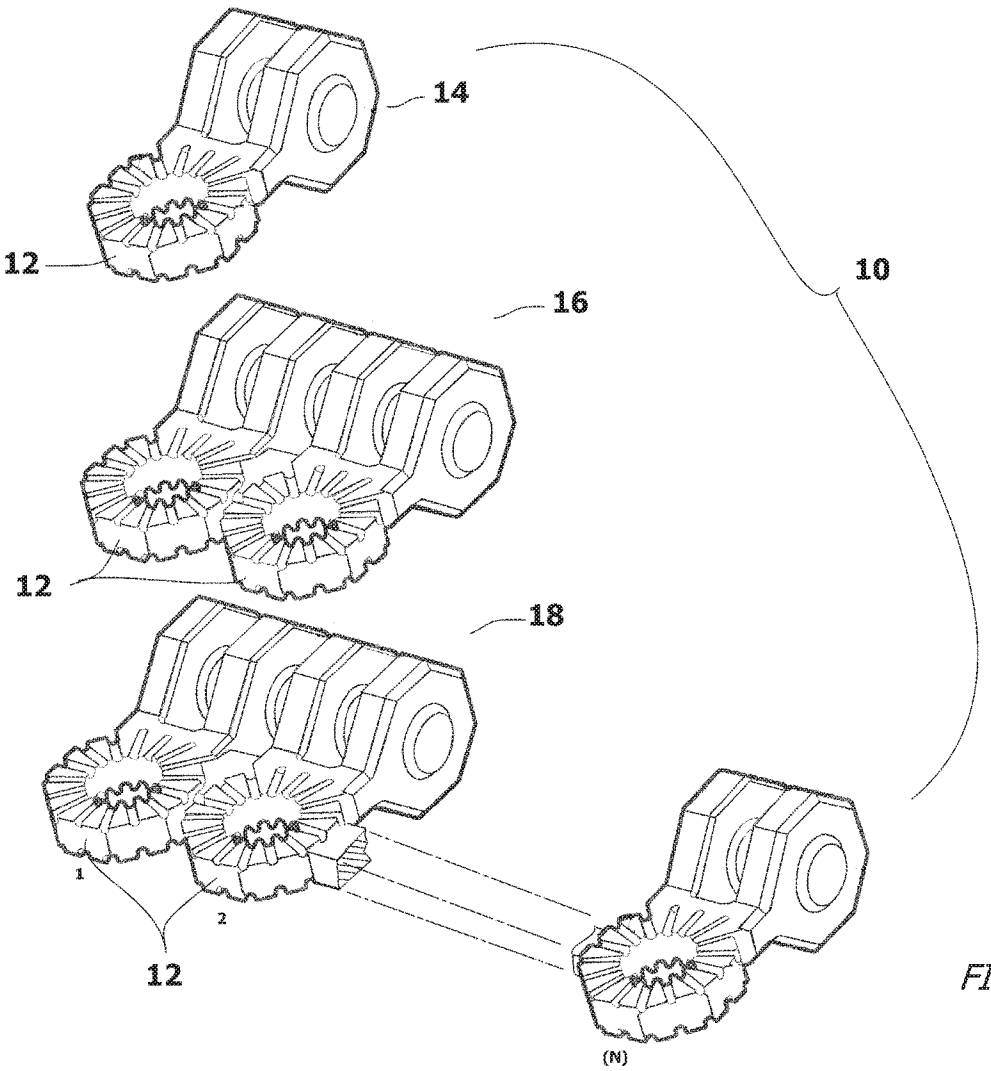
FIG. 1 illustrates a construction toy set having a variety of part types, wherein each of the part types share the same linkage constructs.

Referring to FIG. 1, exemplary parts forming a construction toy set 10 are shown. All of the parts in the construction toy set 10 have one or more linkage constructs 12. The linkage constructs 12 are all identical. However, different parts have different numbers of linkage constructs 12 molded together.

A first part 14 in the construction toy set 10 is comprised of a single linkage construct 12. The structure of the linkage construct 12 is later described. A second part 16 in the construction toy set 10 contains two linkage constructs 12. In FIG. 1, the two linkage constructs 12 are shown linked side-by-side. However, other orientations can also be used. Subsequent parts 18 can contain any number (N) of linkage constructs 12, wherein all the linkage constructs 12 are integrated into a single part. The structure of the linkage constructs 12 in all of the parts 14, 16, 18 is the same. The only difference in the parts 14, 16, 18 is the number of linkage constructs 12 that are formed into a single part.

Figure 4:
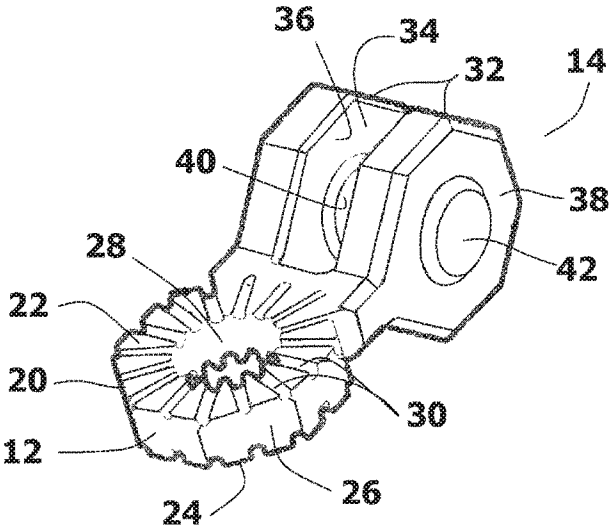
FIG. 4 is a perspective view of the first part type.
Figure 3:
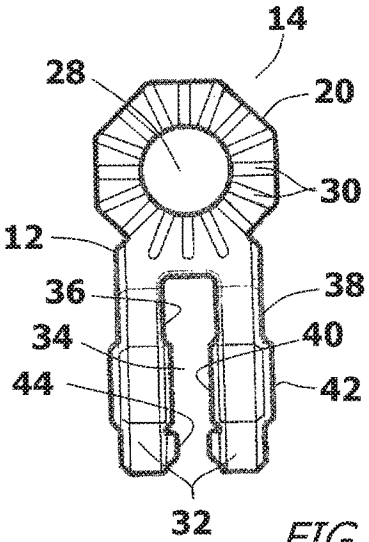
FIG. 3 is a front view of the first part type.
Figure 2:
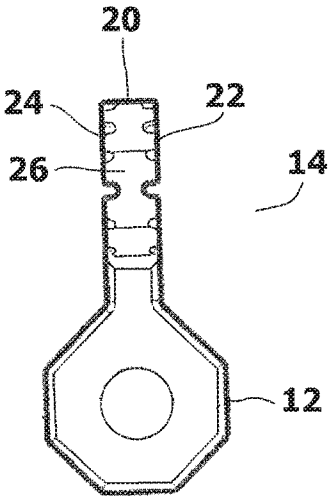
FIG. 2 is a side view of a first part type containing one linkage construct.

Referring to FIG. 2, FIG. 3 and FIG. 4, a first part 14 is shown that contains a single linkage construct 12. The linkage construct 12 has a pivot hub 20. The pivot hub 20 has two surfaces 22, 24 that lay on opposite sides of the pivot hub 20 and extend in parallel planes. The two parallel surfaces 22, 24 are mirror images of each other and are interconnected by a polygonal side surface 26. The two parallel surfaces 22, 24 are spaced apart by the thickness of the pivot hub 20, which corresponds to the width of the polygonal side surface 26. A circular post indentation 28 is formed on both of the parallel surfaces 22, 24 proximate the center of the parallel surfaces, 22, 24. The two post indentations 28 are concentric and are spaced apart by the remaining thickness of the pivot hub 20.

A plurality of radial detents 30 are also formed in each of the parallel surfaces 22, 24 around the post indentations 28. The radial detents 30 surround the post indentations 28 in a radial pattern, wherein at least one radial detent 30 occurs every 15 degrees to 90 degrees around the post indentation 28.

Two yoke arms 32 extend from the pivot hub 20. The two yoke arms 32 extend in parallel planes that are perpendicular to the surfaces 22, 24 of the pivot hub 20. The two yoke arms 32 are separated by a gap space 34. The gap space 34 is sized to receive the pivot hub 20 from another linkage construct 12 with a slight inference fit. As such, the gap space 34 between the two yoke arms 32 is equal to, or just slightly smaller than, the width of the pivot hub 20.

Each yoke arm 32 has an interior flat surface 36 and an opposite exterior flat surface 38. The interior flat surface 36 faces the gap space 34. The exterior flat surface 38 faces away from the gap space 34. The interior flat surfaces 36 and the exterior flat surfaces the flat surfaces 38 from the two yoke arms 32 are parallel. Two interior post extensions 40 extend into the gap space 34 from the two interior flat surfaces 36 of the yoke arms 32. Likewise, two exterior post extensions 42 extend away from the gap space 34 from the two exterior flat surfaces 38 of the yoke arms 32. Both the interior post extensions 40 and the exterior post extensions 42 are sized to be received within the post indentations 28 of another of the linkage constructs 12.

Additionally, an elongated protrusion 44 extends from the interior flat surface 36 of the yoke arms 32 into the gap space 34. The elongated protrusion 44 extends radially from the interior post extension 40. The elongated protrusion 44 is sized to be received by a radial detent 30 in another of the linkage constructs 12.

Figure 5:
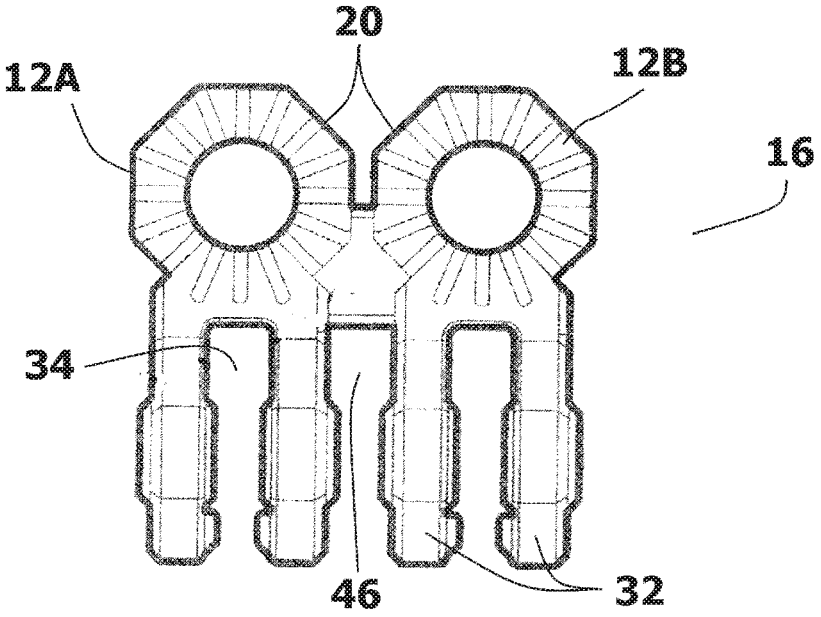
FIG. 5 is a front view of a second part type containing two linkage constructs.
Figure 6:
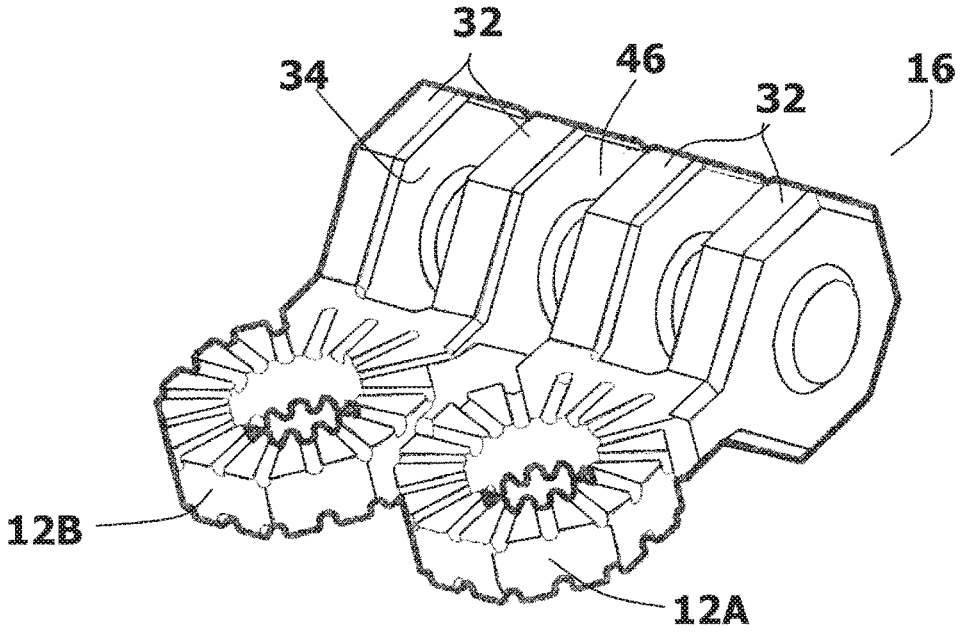
FIG. 6 is a perspective view of the second part type.

Referring to FIG. 5 and FIG. 6, it can be seen that the second part 16 is formed when two linkage constructs 12A, 12B are joined together. When two linkage constructs 12A, 12B are joined together, a second gap space 46 is created between the yoke arms 32 of different linkage constructs 12A, 12B. The gap space 46 between the linkage constructs 12A, 12B is identical to the gap space 34 between yoke arms 32 of any one single linkage construct. Accordingly, a part containing two linkage constructs 12A, 12B will create three gap spaces. Each of the gap spaces 34, 46 is sized to engage the pivot hub 20 from another part. If the part has (N) number of linkage constructs 12, that same part will have (N+1) number of gap spaces.

Figure 7:
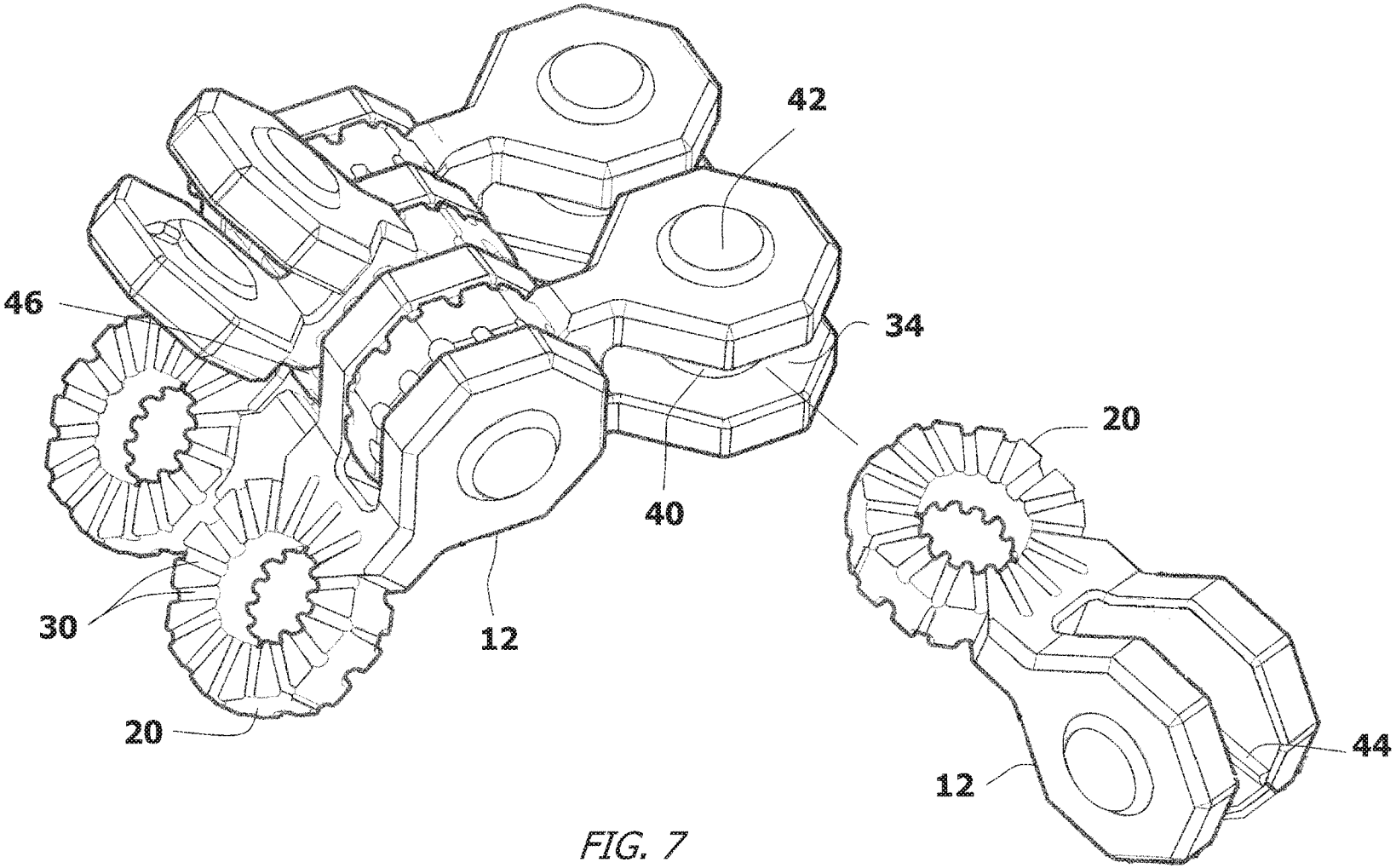
FIG. 7 is a perspective view of an assembly containing different part types.
Figure 8:
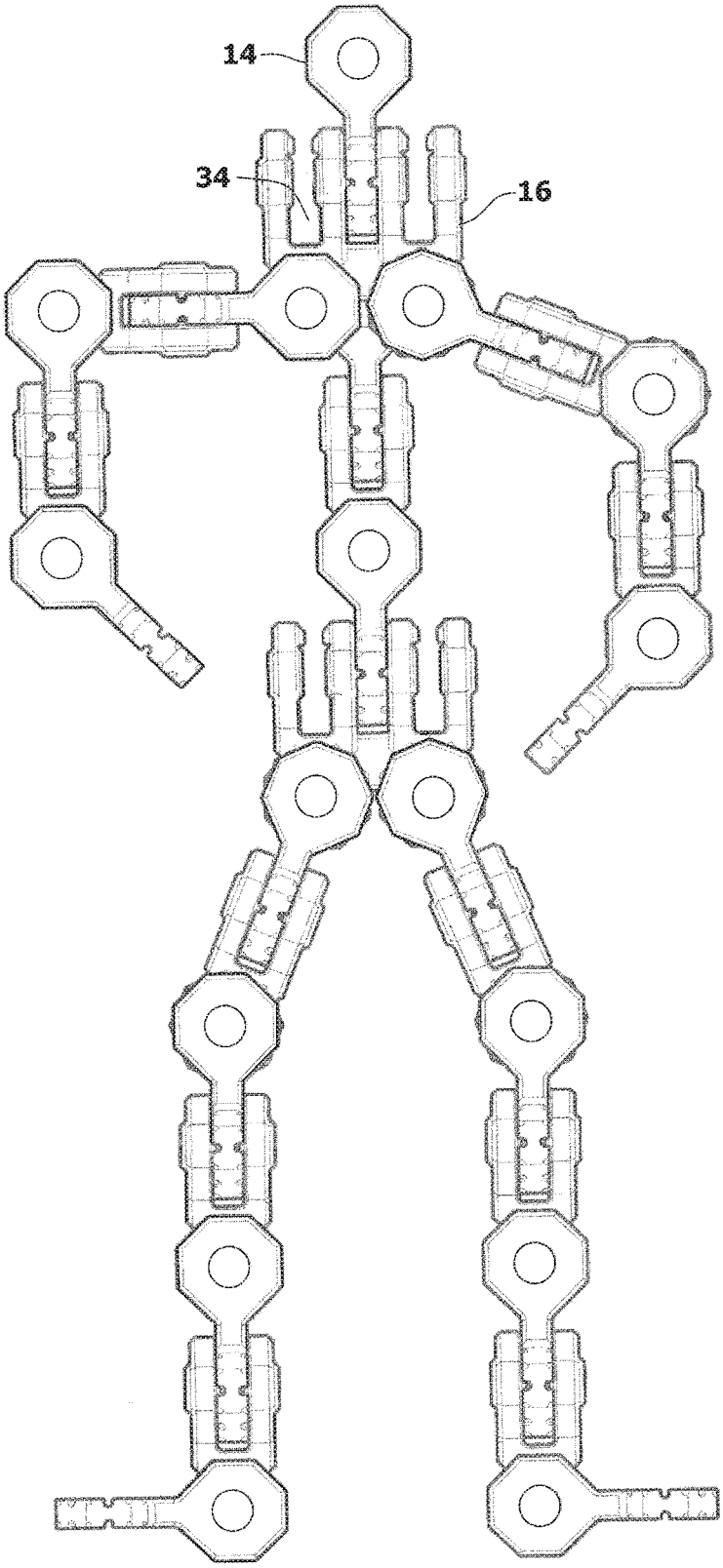
FIG. 8 is a front view of a complete construction containing different part types.

Referring to FIG. 7 and FIG. 8 in conjunction with the earlier figures, it can be seen that the linkage constructs 12 between any two parts can mechanically interconnect. The linkage constructs 12 interconnect by passing the pivot hub 20 of a linkage construct 12 of a first part into the gap space 34, 46 between the yoke arms 32 on another part. Upon contact, there is a slight interference fit. As such, the two yoke arms 32 on one part must spread slightly to allow for the passage of the pivot hub 20 from another part. As the pivot hub 20 enters one of the gap spaces 34, 46, either the interior post extensions 40 or the exterior post extensions 42 from one part snap into the post indentations 28 of the pivot hub 20 of a different part.

Once parts are interconnected, a joint connection is formed that enables the linkage construct 12 from a first part to be rotated relative the linkage construct 12 from another part and vice versa. As the linkage construct 12 of a first part rotates relative the linkage construct 12 of a second part, the elongated protrusions 44 on the yoke arms 32 rotate into and out of the various radial detents 30 on the pivot hub 20. This resists any rotational movement and requires that a threshold force be applied between parts in order to rotate one part relative the other. When one part is moved relative another, the elongated protrusion 44 creates audible snap noises as it moves from one radial detent 30 to another. It will therefore be understood that the post indentation 28 is a feature on a first part that intermeshes with the post extension 40 of a second part. Likewise, the radial detents 30 on a first part are features that intermesh with the elongated protrusion 44 of a second part. This creates a strong, stable interconnection that will not separate or rotate on its own, but can be readily separated and rotated via intentional manual manipulation.

The parts with one linkage construct 12 can interconnect to form long chains. At any point, larger parts with multiple linkage constructs 12 can be added to the assembly. This provides the ability to expand the assembly into multiple chains that extend in multiple directions. From FIG. 7 and FIG. 8, it can be seen that by combining parts having one linkage construct 12 with parts having multiple linkage constructs 12, complex shapes and structures can be created. The interconnection of the radial detents 30 and the elongated protrusions 44 prevent the jointed connection between any two parts from moving under the weight of the assembly. This enables large assemblies to be created without the assembly losing stability.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. A construction toy set containing a plurality of interlocking pieces, wherein each of said interlocking pieces contains at least one linkage construct and each linkage construct includes:

a pivot hub having a first surface and an opposite second surface, wherein said first surface and said second surface are parallel;

detents formed in both said first surface and said second surface of said pivot hub, wherein said detents are arranged in a radial pattern;

post indentations concentrically formed in both said first surface and said second surface of said pivot hub;

a first yoke arm coupled to said pivot hub, wherein said first yoke arm has a first interior surface and a first exterior surface, wherein said first interior surface and said first exterior surface are arranged perpendicular to said first surface of said pivot hub;

post extensions that extend from both said first interior surface and said first exterior surface of said first yoke arm, wherein said post extensions are sized to be received by said post indentations;

a first protrusion extending from said first interior surface of said first yoke arm, wherein said first protrusion is sized to be received by one of said detents;

a second yoke arm coupled to said pivot hub, wherein said second yoke arm has a second interior surface and a second exterior surface, wherein said second interior surface and said second exterior surface are arranged perpendicular to said first surface of said pivot hub; and a first gap space separating said first interior surface of said first yoke arm from said second interior surface of said second yoke arm, wherein said first protrusion extends into said first gap space, and wherein said first gap space is sized to receive and retain said pivot hub.

2. The construction toy set according to claim 1, wherein some of said plurality of interlocking pieces contain different numbers of said at least one linkage constructs.

3. The construction toy set according to claim 1, wherein some of said plurality of interlocking pieces contain a first linkage construct and a second linkage construct joined together into a single piece.

4. The construction toy set according to claim 3, wherein a second gap space is disposed between said first linkage construct and said second linkage construct, wherein said second gap space is sized to receive and retain said pivot hub.

5. The construction toy set according to claim 1, wherein said post extensions further extend from both said second interior surface and said second exterior surface of said second yoke arm, wherein said post extensions are sized to be received by said post indentations.

6. The construction toy set according to claim 1, wherein said pivot hub has a polygonal side surface that separates said first surface and said second surface.

7. A construction toy set containing a plurality of interlocking pieces, wherein at least some of said interlocking pieces contain at least a first linkage construct and a second linkage construct, wherein said first linkage construct and said second linkage construct both include:

a pivot hub having a first surface and an opposite second surface, wherein said first surface and said second surface are arranged in parallel;

a first yoke arm coupled to said pivot hub, wherein said first yoke arm has a first interior surface and a first exterior surface, wherein said first interior surface and said first exterior surface are arranged perpendicular to said first surface of said pivot hub;

a second yoke arm coupled to said pivot hub, wherein said second yoke arm has a second interior surface and a second exterior surface, wherein said second interior surface and said second exterior surface are arranged perpendicular to said first surface of said pivot hub; and a first gap space separating said first interior surface of said first yoke arm from said second interior surface of said second yoke arm, wherein said first gap space is sized to receive and retain said pivot hub;

a second gap space is disposed between said first linkage construct and said second linkage construct, wherein said second gap space is sized to receive and retain said pivot hub.

8. The construction toy set according to claim 7, wherein said first linkage construct and said second linkage construct each having a first surface on said pivot hub that are coplanar.

9. The toy construction set according to claim 7, further including detents formed in both said first surface and said second surface of said pivot hub, wherein said detents are arranged in a radial pattern.

10. The toy construction set according to claim 9, further including a first protrusion extending from said first interior surface of said first yoke arm, wherein said protrusion is sized to be received by one of said detents.

11. The construction toy set according to claim 7, further including post indentations concentrically formed into said first surface and said second surface of said pivot hub.

12. The construction toy set according to claim 11, further including post extensions that extend from both said first interior surface and said first exterior surface of said first yoke arm, wherein said post extensions are sized to be received by said post indentations.

13. The construction toy set according to claim 12, wherein said post extensions further extend from both second interior surface and said second exterior surface of said second yoke arm, wherein said post extensions are sized to be received by said post indentations.

14. An interlocking piece for use in a construction toy set, said interlocking piece comprising:

a first pivot hub;

a second pivot hub;

a first yoke arm coupled to said first pivot hub;

a second yoke arm coupled to said first pivot hub;

a third yoke arm coupled to said second pivot hub;

a fourth yoke arm coupled to said second pivot hub;

a first gap space separating said first yoke arm from said second yoke arm, wherein said first gap space is sized to receive and retain said first pivot hub;

a second gap space separating said second yoke arm from said third yoke arm, wherein said second gap space is sized to receive and retain said first pivot hub; and a third gap space separating said third yoke arm from said fourth yoke arm, wherein said third gap space is sized to receive and retain said first pivot hub.

15. The interlocking piece according to claim 14, wherein said first yoke arm, said second yoke arm, said third yoke arm and said fourth yoke arm extend in parallel in a common direction.

* * * * *